US007810654B1

(12) United States Patent
Wang

(10) Patent No.: US 7,810,654 B1
(45) Date of Patent: Oct. 12, 2010

(54) HANGING RACK ASSEMBLY

(76) Inventor: Wen-Tsan Wang, 6F., No. 300, Jui Kuang Road, Taipei city (TW)

( * ) Notice: Subject to any disclaimer, the term of this patent is extended or adjusted under 35 U.S.C. 154(b) by 20 days.

(21) Appl. No.: 12/436,817

(22) Filed: May 7, 2009

(51) Int. Cl.
*A47F 5/00* (2006.01)

(52) U.S. Cl. ..... 211/106.01; 211/118; 211/119.004; 248/224.8; 248/339

(58) Field of Classification Search ..... 211/89.01, 211/103, 106.01, 113, 117, 118, 119.004; 248/339, 304, 224.8
See application file for complete search history.

(56) References Cited

U.S. PATENT DOCUMENTS 4,058,222 A * 11/1977 Singer ..... 211/118
4,311,243 A * 1/1982 Hui-Lai ..... 211/113
4,358,232 A * 11/1982 Griffith ..... 410/100
4,387,873 A * 6/1983 Pavlo et al. ..... 248/227.1
4,428,099 A * 1/1984 Richmond ..... 24/68 CD
4,846,430 A * 7/1989 Ke ..... 248/215
5,141,113 A * 8/1992 Elliott ..... 211/85.2
5,259,497 A * 11/1993 Brothers et al. ..... 206/6.1
6,299,000 B1 * 10/2001 Cabrera ..... 211/70.2
7,527,157 B2 * 5/2009 Shinn et al. ..... 211/89.01

* cited by examiner

*Primary Examiner*—Korie Chan
(74) *Attorney, Agent, or Firm*—Leong C. Lei

(57) ABSTRACT

A hanging rack assembly includes a hanging strap having transverse pin holes at different elevations, a hanging hook for hooking the hanging strap on a support and having an angled hook portion at one end, an arched hook portion at the other end and a transverse slot on the middle for the passing of the hanging strap, hanging racks respectively formed of two vertical bars, two transverse bars and multiple hanger bars and respectively fastened to the hanging straps at different elevations for hanging things, each hanging rack defining a vertically extending passage for the passing of the hanging strap, and positioning pins respectively fitted into the transverse pin holes of the hanging strap to secure the hanging hook and the hanging rack to the hanging strap.

7 Claims, 13 Drawing Sheets

HANGING RACK ASSEMBLY

BACKGROUND OF THE INVENTION (a) Technical Field of the Invention

The present invention relates to hanging racks for hanging things and more particularly, to a hanging rack assembly, which is easy to assemble and allows adjustment of the number of hanging elements subject to actual requirements.

(b) Description of the Prior Art

Hanging racks and clothes trees are intensively used in offices and houses for hanging hats, handbags, shopping bags, clothes, and many other personal things. However, these hanging racks and clothes trees occupy much floor space. Further, a hanging rack or clothes tree has a limited number of hooks or pegs for hanging things. The number of hooks or pegs of a hanging rack or clothes tree is not adjustable to fit different requirements. Further, people may affix a hanging rack to the door panel of a door in a house with screws or an adhesive, or hang a hanging rack on the topmost edge of the door panel for hanging things. After installation of a hanging rack in the door panel of a door, the hanging capacity of the hanging rack is not adjustable to fit actual needs.

SUMMARY OF THE INVENTION

The primary purpose of the present invention is to provide a hanging rack assembly, which is easy to assemble and allows adjustment of the number of hanging elements subject to actual requirements.

To achieve this and other objects of the present invention, the hanging rack assembly comprises a hanging strap having a plurality of transverse pin holes arranged at different elevations, a hanging hook adapted to hook the hanging strap on a support and having an angled hook portion located on one end thereof, an arched hook portion located on an opposite end thereof and a transverse slot located on a middle part thereof for the passing of the hanging strap, hanging racks fastened to the hanging straps at different elevations for hanging things, each hanging rack comprising two vertical flat bars arranged in parallel, two transverse bars respectively fastened to front and back sides of the vertical bars and kept in flush with the topmost edges of the vertical bars and defining with the vertical bars a vertically extending passage, and a plurality of hanger bars respectively obliquely fastened to the vertical bars for hanging things, and positioning pins respectively fitted into the transverse pin holes of the hanging strap to secure the hanging hook and the hanging rack to the hanging strap.

Further, the hanger bars can be respectively obliquely fastened to the front and back sides of the vertical bars for hanging things. Alternatively, the hanger bars can be respectively obliquely fastened to the front side of each of the vertical bars.

In one embodiment, the hanging strap is formed of two narrow elongated flexible sheet members that are fastened together with stitches, having the transverse pin holes defined therein at different elevations.

In an alternate form of the present invention, the hanging strap is formed of a single elongated flexible sheet member having multiple parts thereof folded up and stitched to provide a plurality of transverse pockets at different elevations. The said transverse through holes are respectively defined in the transverse pockets.

Further, hanger hooks may be selectively used and fastened to the hanging strap to substitute for the hanging racks for hanging things. Each hanger hook has a transverse slot for the passing of the hanging strap. The transverse slot of each hanger hook is approximately equal to the transverse slot of the hanging hook in size.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
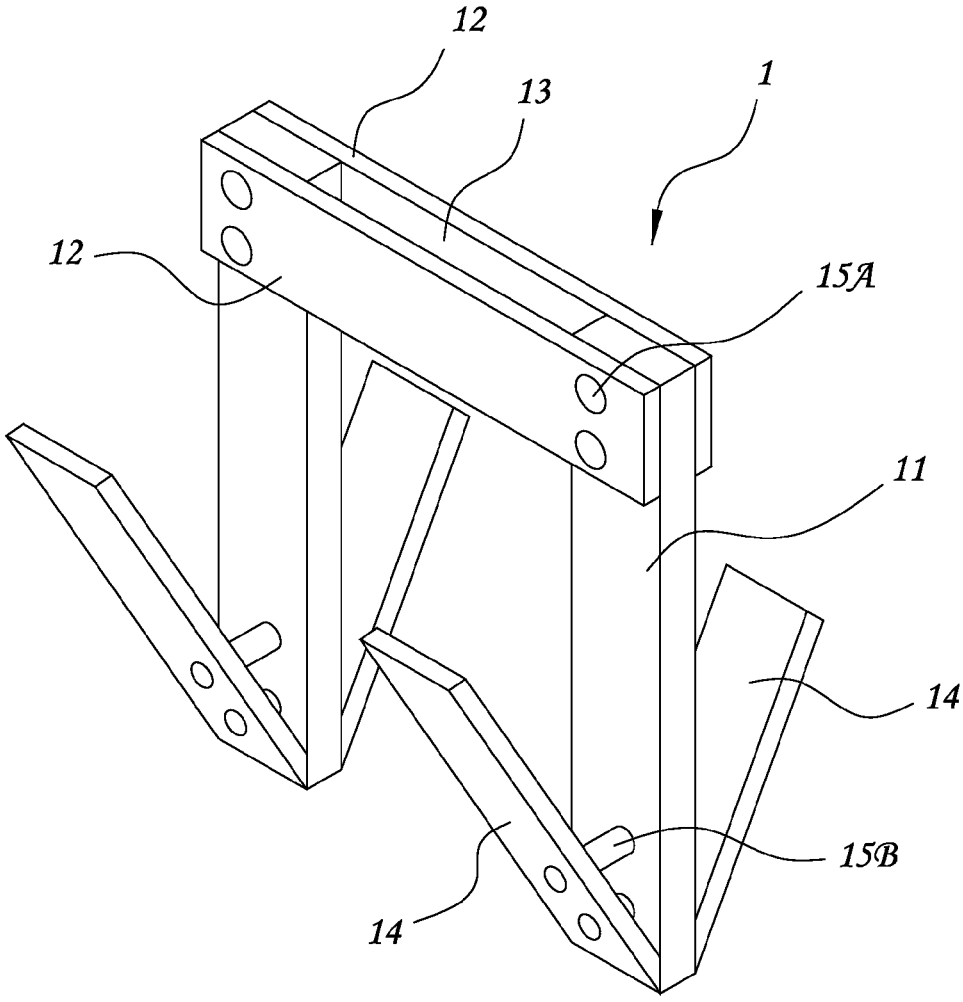
FIG. 1 is an elevational view of a hanging rack for hanging rack assembly in accordance with the present invention.
Figure 2:
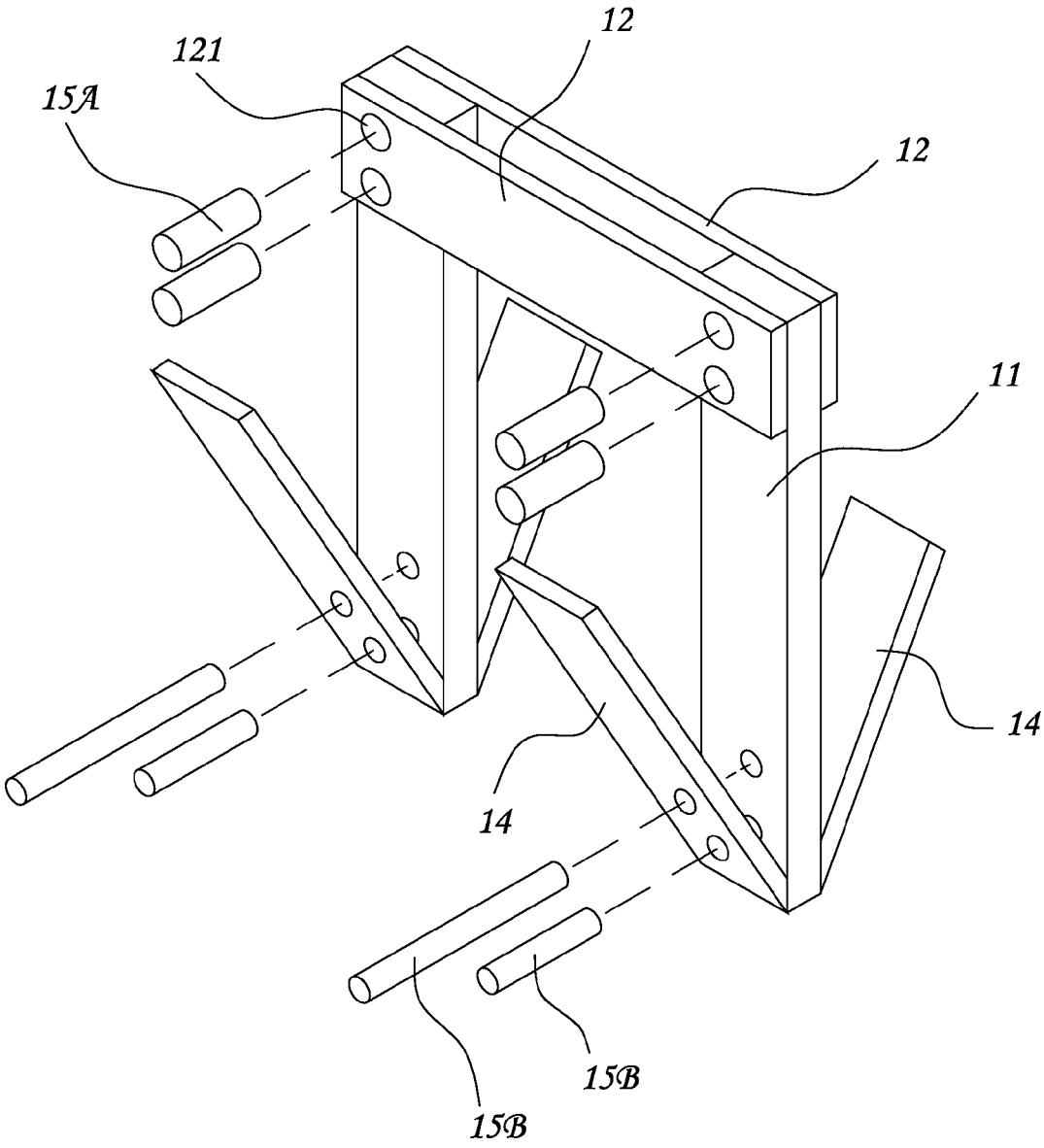
FIG. 2 is an exploded view of the hanging rack shown in FIG. 1.
Figure 3:
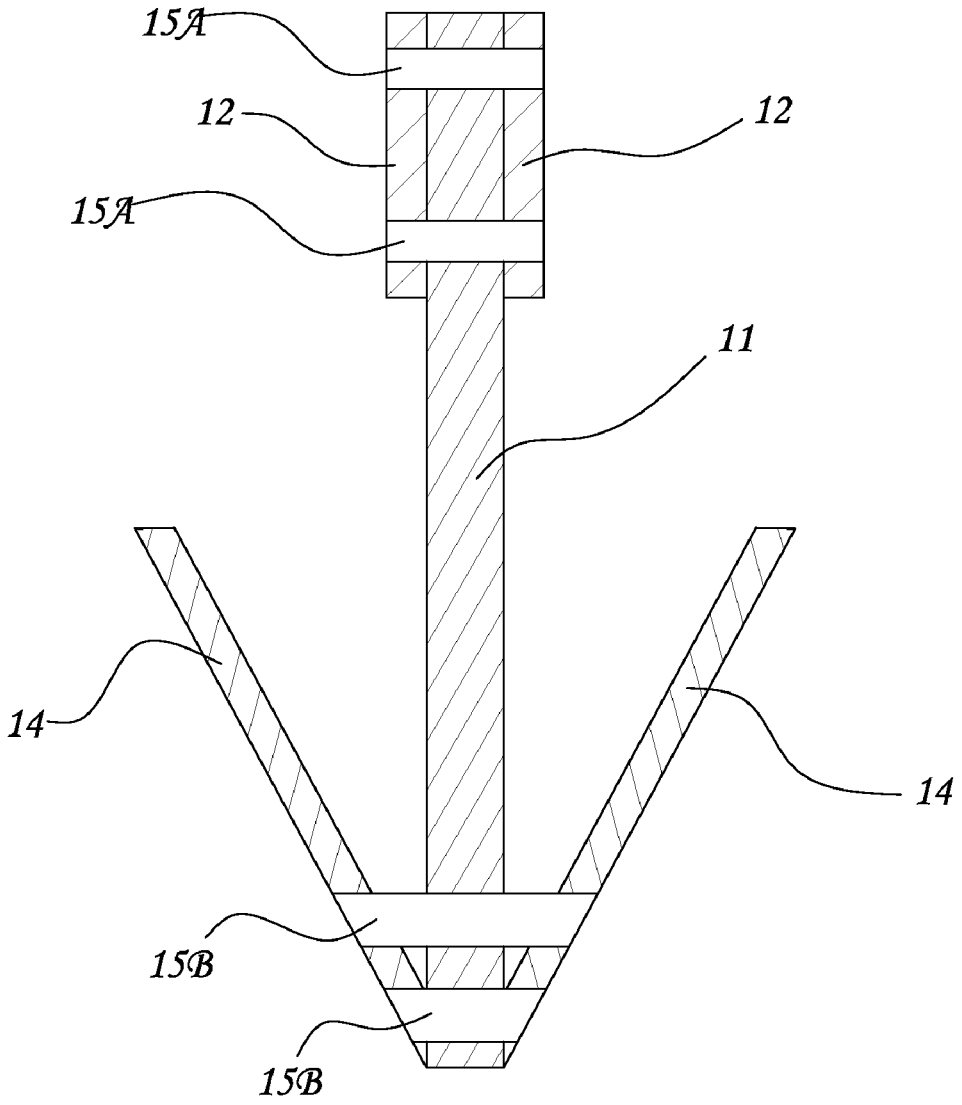
FIG. 3 is a sectional side view of the hanging rack shown in FIG. 1.
Figure 4:
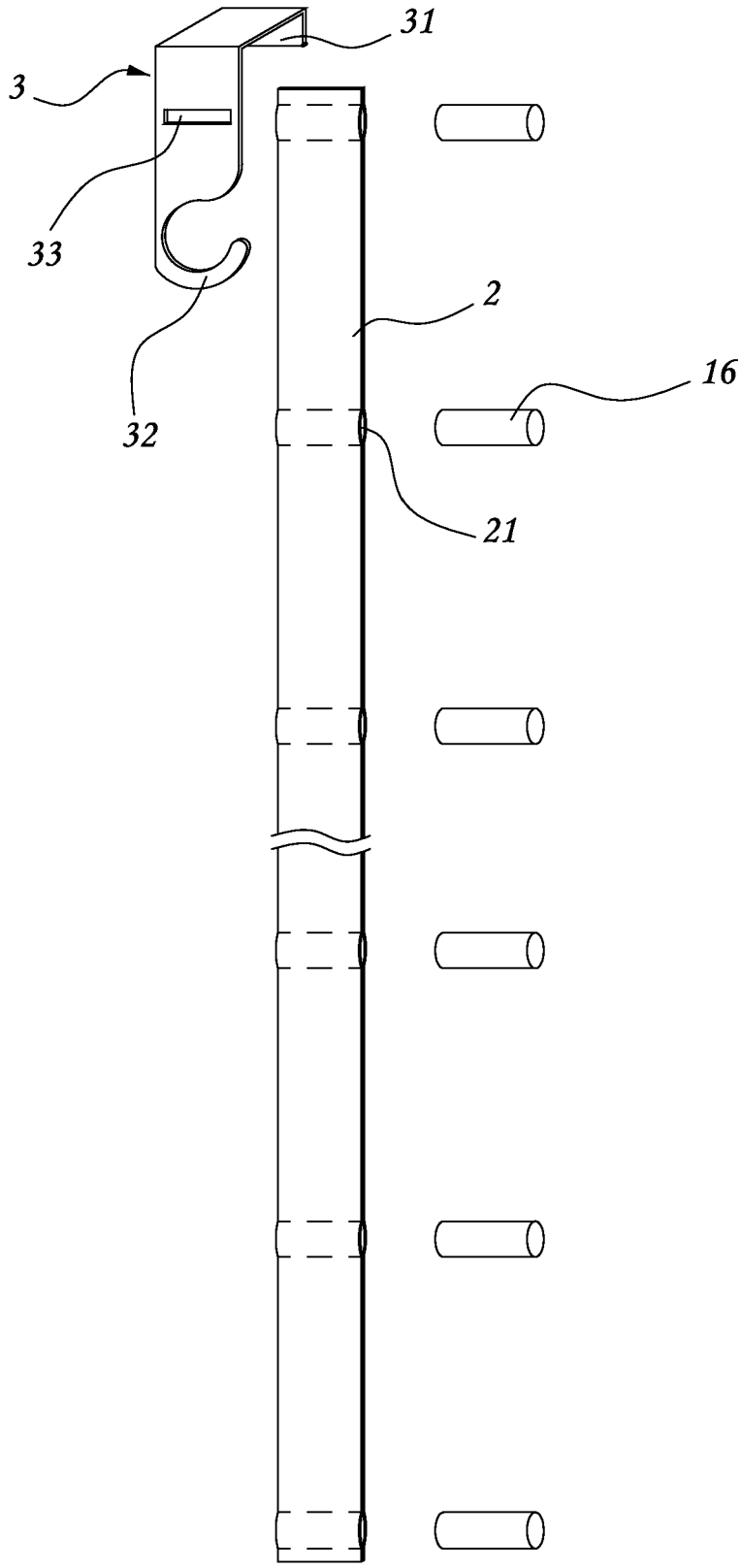
FIG. 4 is a perspective view of a part of the hanging rack assembly in accordance with the present invention, showing the structure of the hanging strap and hanging hook.

Referring to FIGS. 1~3, a hanging rack 1 is shown comprising two vertical flat bars 11 arranged in parallel, two transverse bars 12 respectively attached to two opposite sides of the vertical bars 11 and kept in flush with the topmost edges of the vertical bars 11, a plurality of dowel pins 15A respectively fitted into respective pin holes 121 on the transverse bars 12 and respective pin holes (not shown) on the vertical bars 11 to affix the vertical bars 11 and the transverse bars 12 together, and a plurality of hanger bars 14 respectively obliquely fastened with bottom ends thereof to two opposite sides of the bottom ends of each of the vertical bars 11 with dowel pins 15B. Further, an adhesive may be applied to the dowel pins 15B and the respective pin holes on the vertical bars 11 and the hanger bars 14 to enhance tightness of connection between the vertical bars 11 and the hanger bars 14. When hanging rack 1 is assembled, a passage 13 is defined between the transverse bars 12. Referring to FIG. 4, a hanging strap 2 is formed by means of stitching two narrow elongated flexible sheet members together, having a plurality of transverse pin holes 21 disposed at different elevations. A plurality of positioning pins 16 are respectively detachably fitted into the transverse pin holes 21. Further, a hanging hook 3 is detachably fastened to the hanging strap 2 for hanging the hanging strap 2 on a support, for example, the door panel of a room. The hanging hook 3 has an angled hook portion 31 at one end, an arched hook portion 32 at an opposite end, and a transverse slot 33 on the middle. The transverse slot 33 allows insertion of the hanging strap 2. Further, the diameter of the positioning pins 16 is greater than the width of the transverse slot 33 and the width of the passage 13 between the transverse bars 12. Thus, the positioning pins 16 cannot pass through the transverse slot 33 of the hanging hook 3 or the passage 13 of the hanging rack 1.

Figure 5:
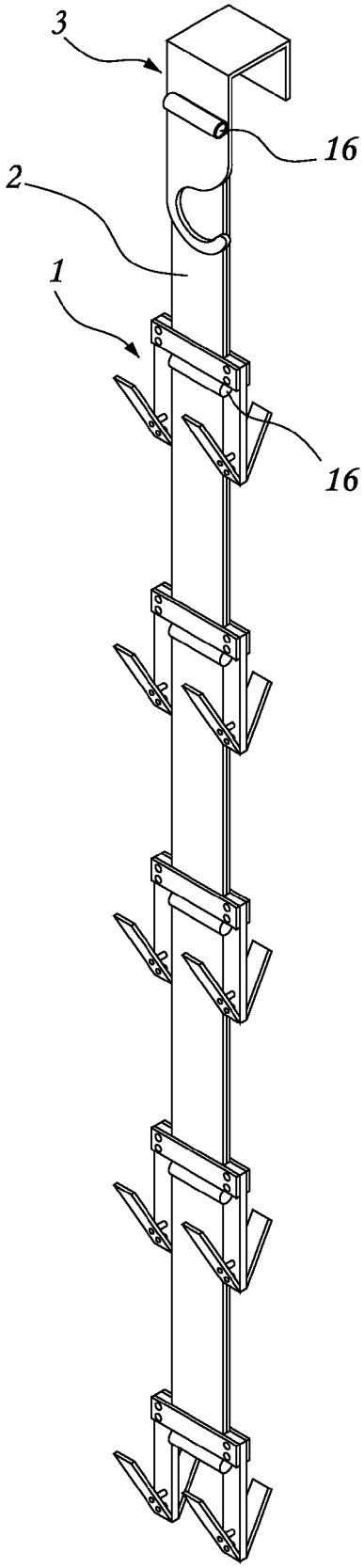
FIG. 5 is an elevational assembly view of the hanging rack assembly in accordance with the present invention.
Figure 6:
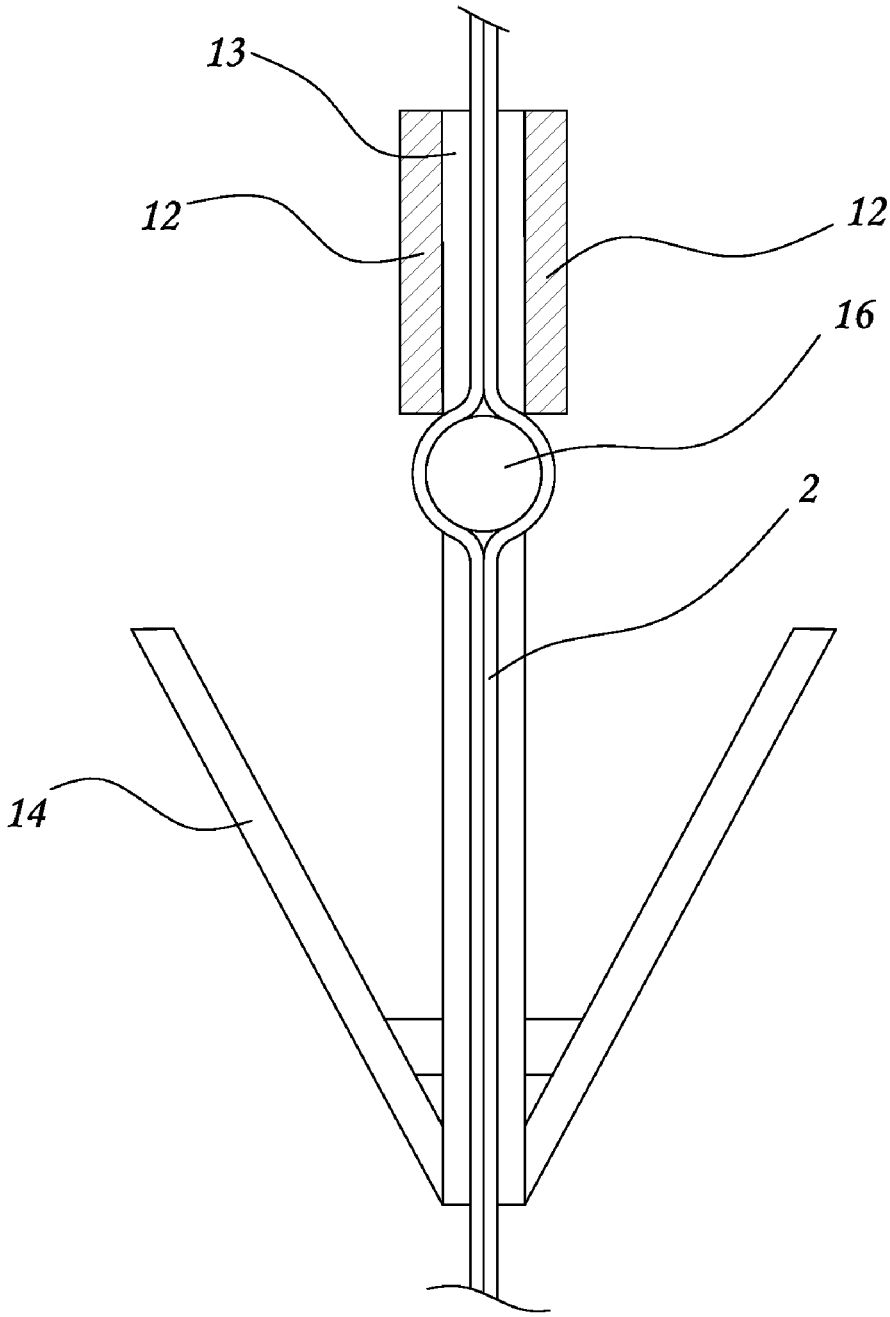
FIG. 6 is a sectional side view of a part of the hanging rack assembly in accordance with the present invention, showing connection between the hanging rack and the hanging strap.
Figure 7:
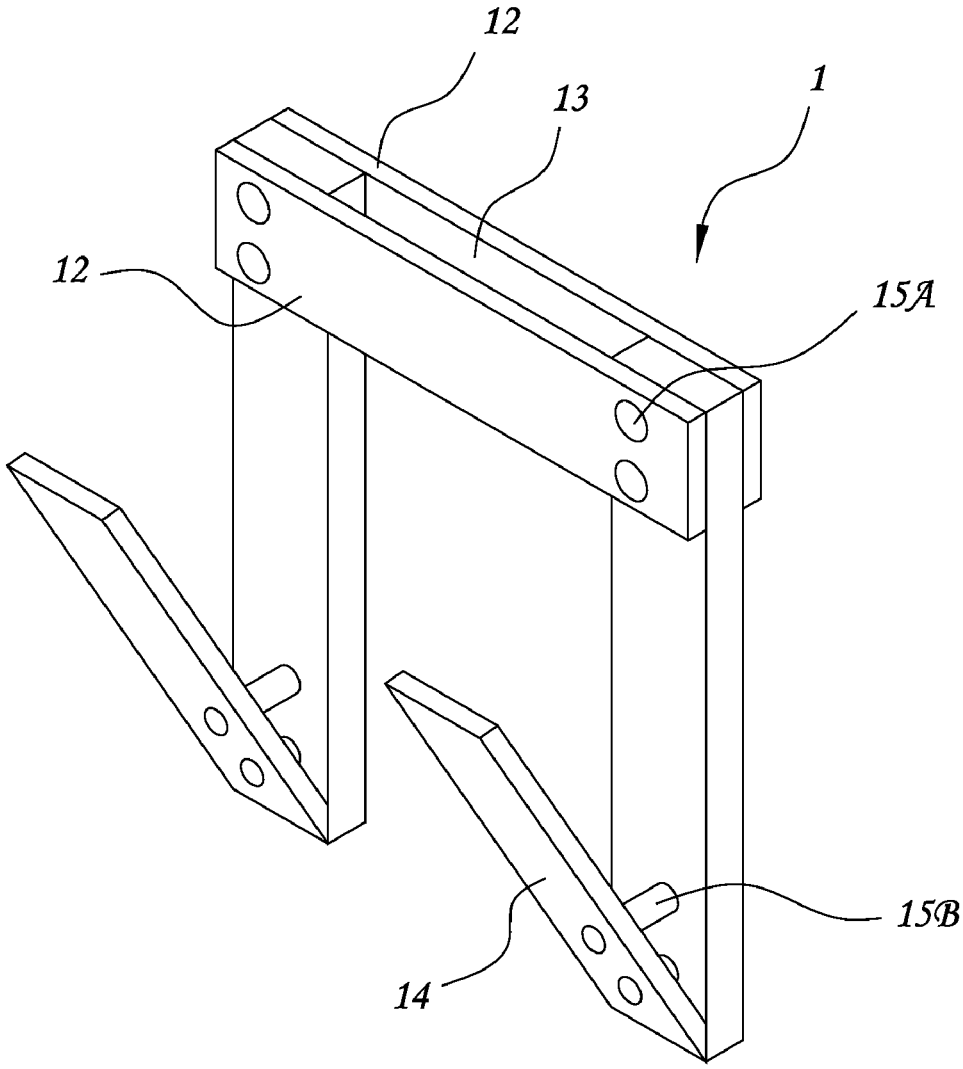
FIG. 7 is an elevational view of an alternate form of the hanging rack for hanging rack assembly in accordance with the present invention.
Figure 8:
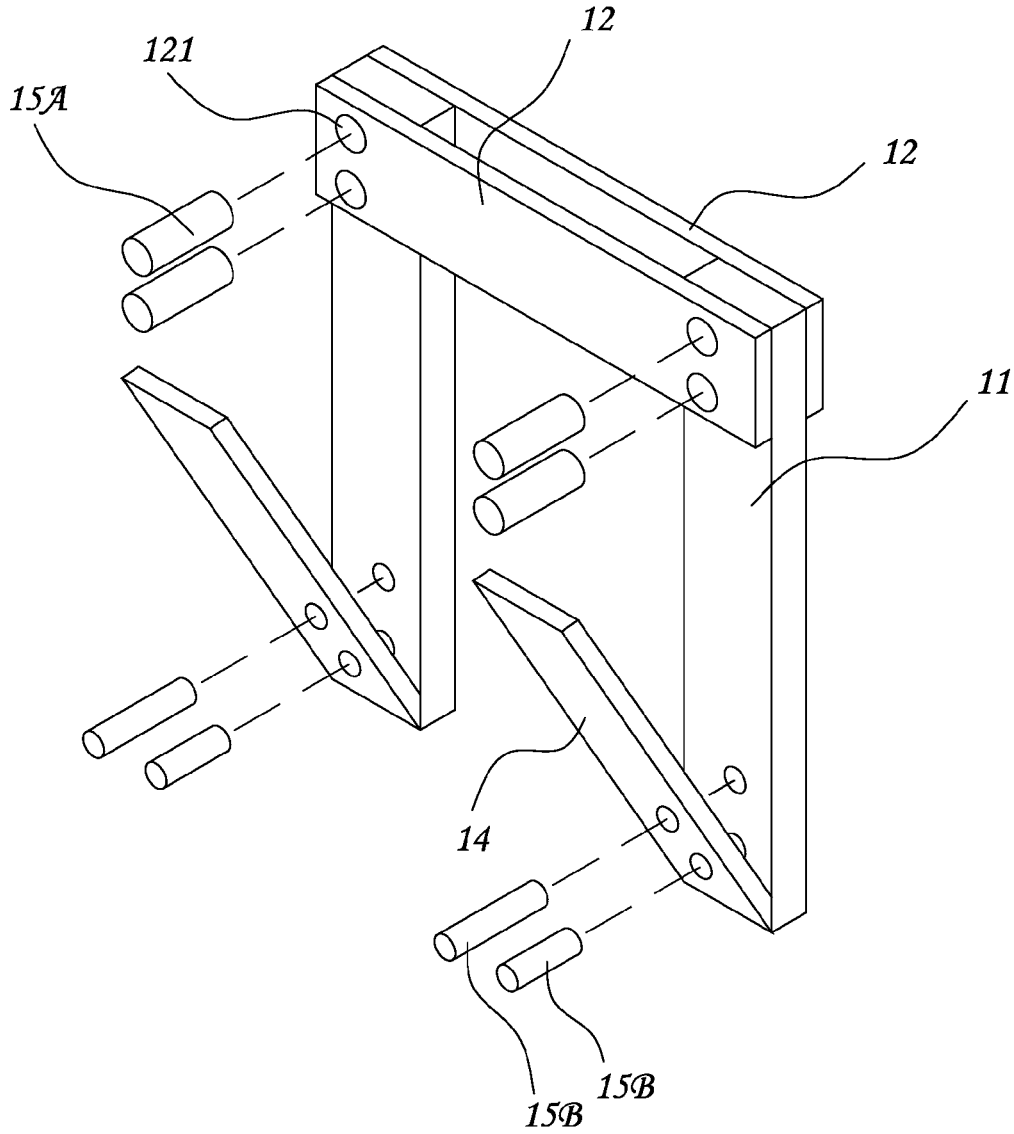
FIG. 8 is an exploded view of the hanging rack shown in FIG. 7.
Figure 9:
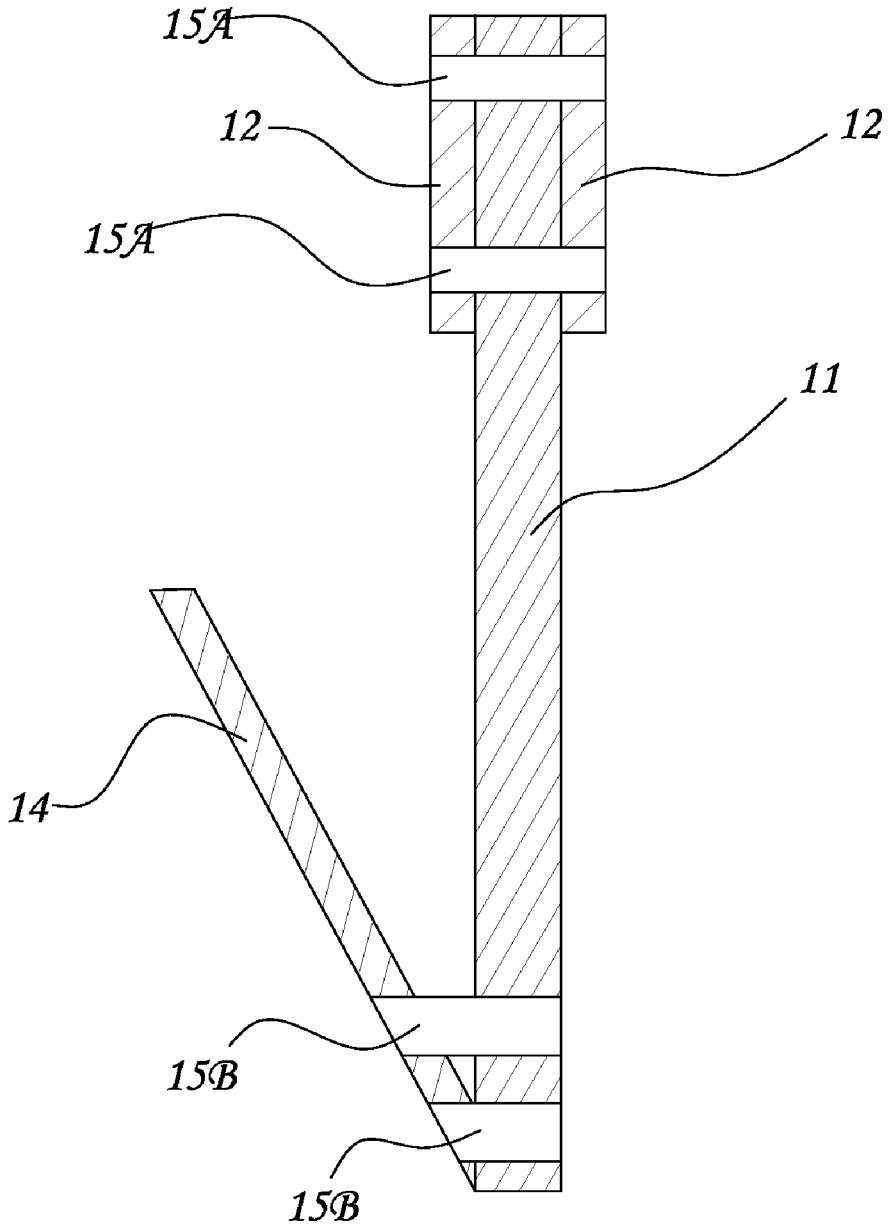
FIG. 9 is a sectional side view of the hanging rack shown in FIG. 8.
Figure 10:
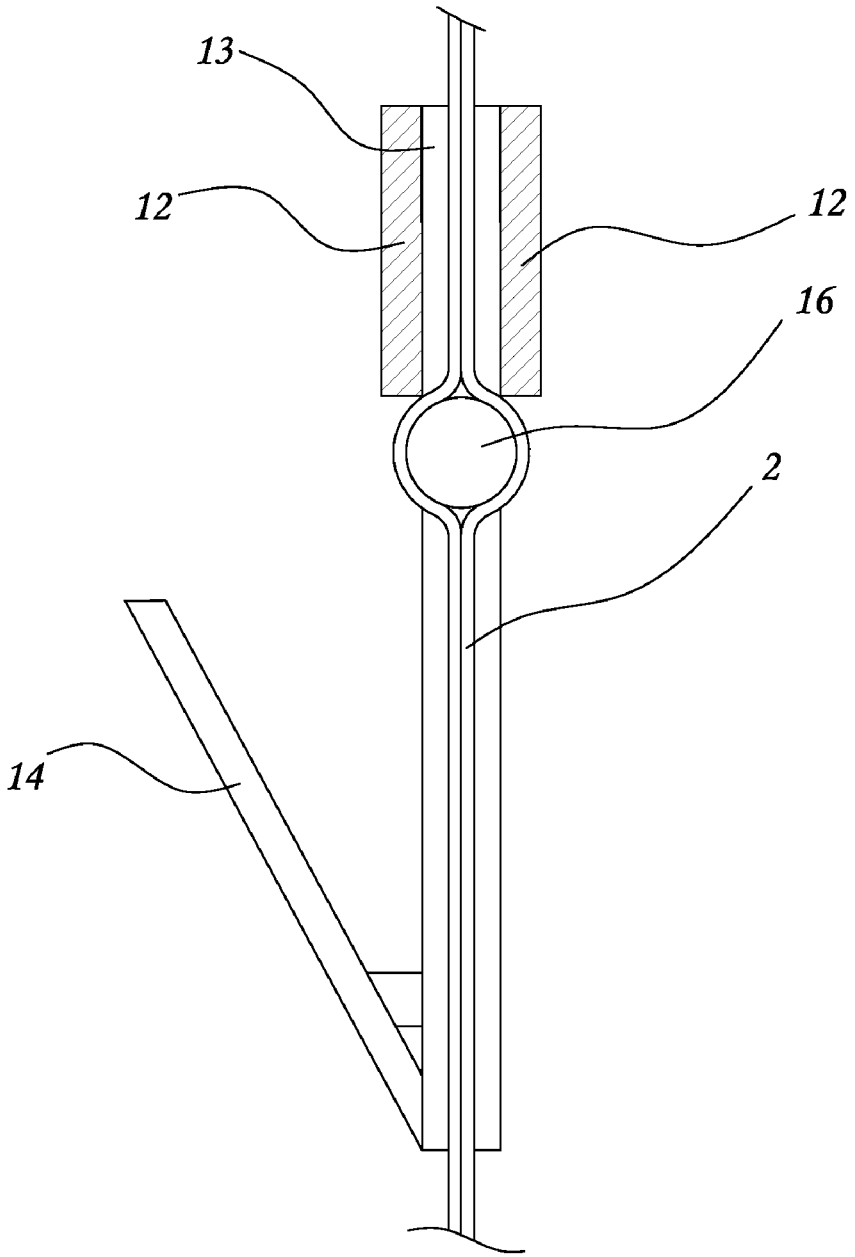
FIG. 10 is a sectional side view of the present invention, showing the hanging rack of FIG. 8 fastened to the hanging strap.

Referring to FIGS. 5 and 6, the hanging strap 2, the hanging hook 3 and a number of hanging racks 1 are assembled, forming a hanging rack assembly. When fastening one hanging rack 1 to the hanging strap 2, insert the hanging strap 2 through the passage 13 of the hanging rack 1 to have one selected transverse pin hole 21 be disposed beneath the transverse bars 12, and then insert one positioning pin 16 into the transverse pin hole 21 to have the transverse bars 12 be stopped above the positioning pin 16 (see FIG. 6). When fastening hanging hook 3 to the hanging strap 2, insert a part of the hanging strap 2 around one transverse pin hole 21 through the transverse slot 33 of the hanging hook 3, and then insert one positioning pin 16 into the transverse pin hole 21 to secure the hanging hook 3 to the hanging strap 2. By means of the angled hook portion 31 of the hanging hook 3, the hanging rack assembly can be hung on the top edge of a door panel of a room. Further, the hanging hook 3 can be fastened to the hanging strap 2 in such a position that the arched hook portion 32 is disposed at the top side for hanging on a hanging rod.

FIGS. 7~10 show an alternate form of the hanging rack 1. This alternate form is substantially similar to the hanging rack 1 shown in FIGS. 1~3 with the exception that this alternate form has only one hanger bar 14 obliquely fastened to one side of the bottom end of each of the vertical bars 11. This alternate form is simply designed for single-side hanging. The installation of this alternate form is same as the aforesaid assembly process.

Figure 11:
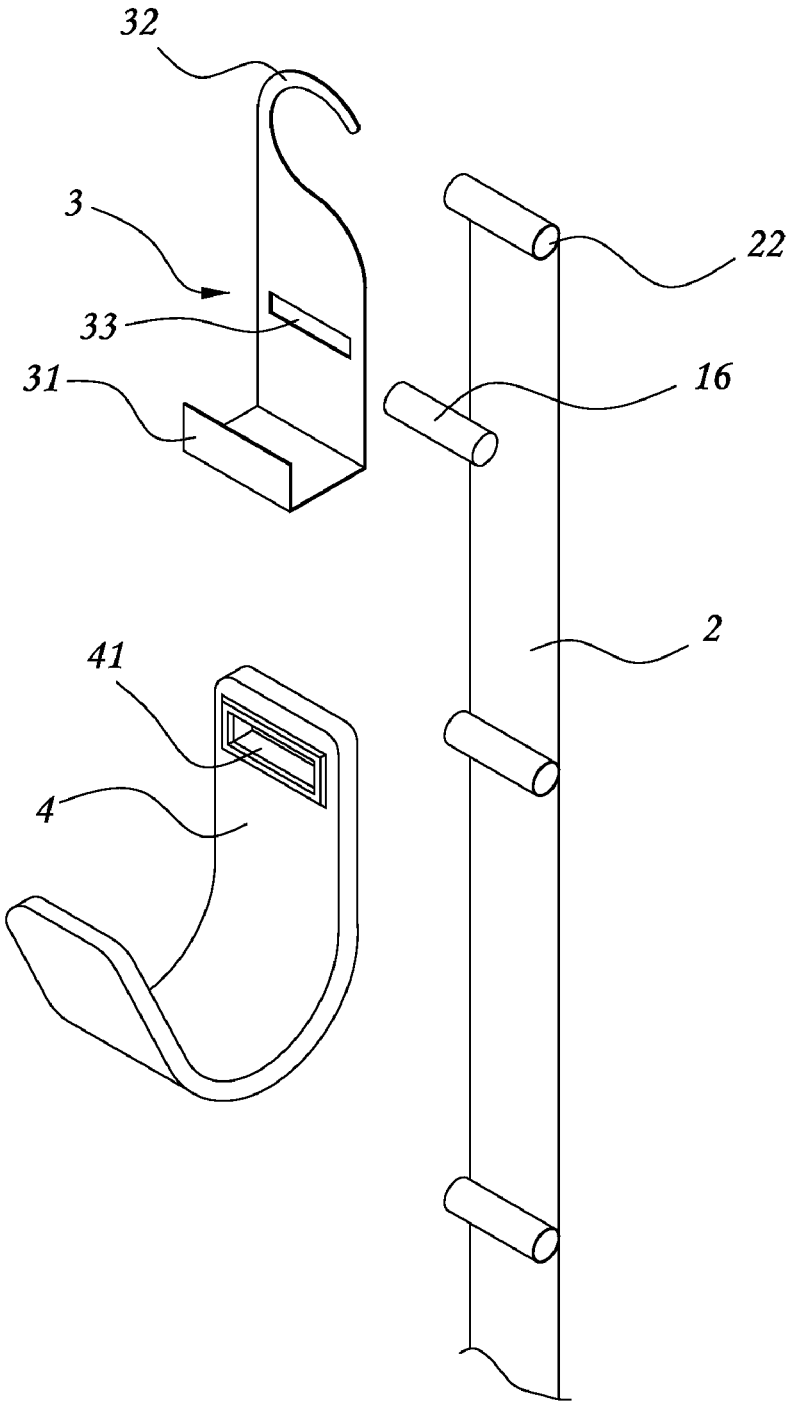
FIG. 11 is an exploded view of a part of an alternate form of the hanging rack assembly in accordance with the present invention.
Figure 12:
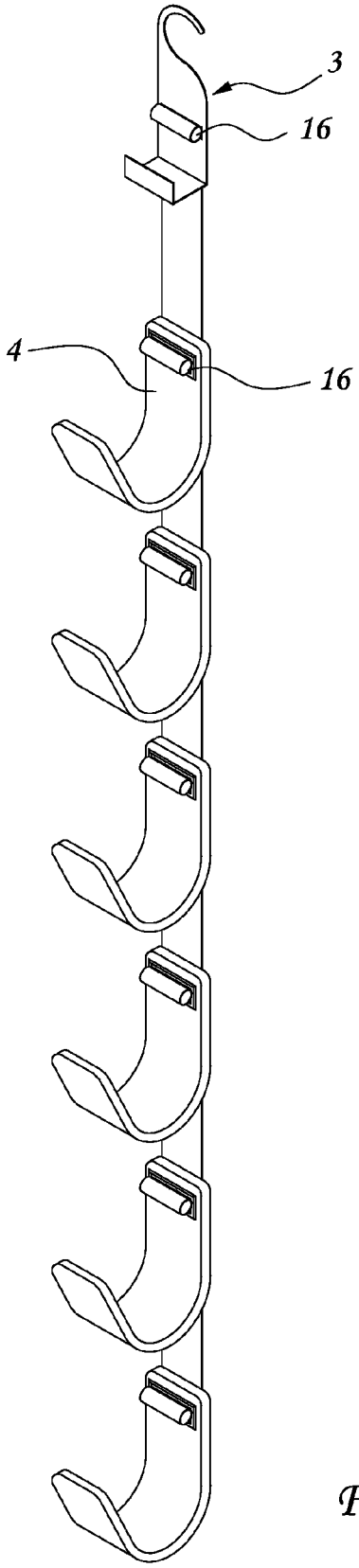
FIG. 12 is an elevational view of the hanging rack assembly shown in FIG. 11.
Figure 13:
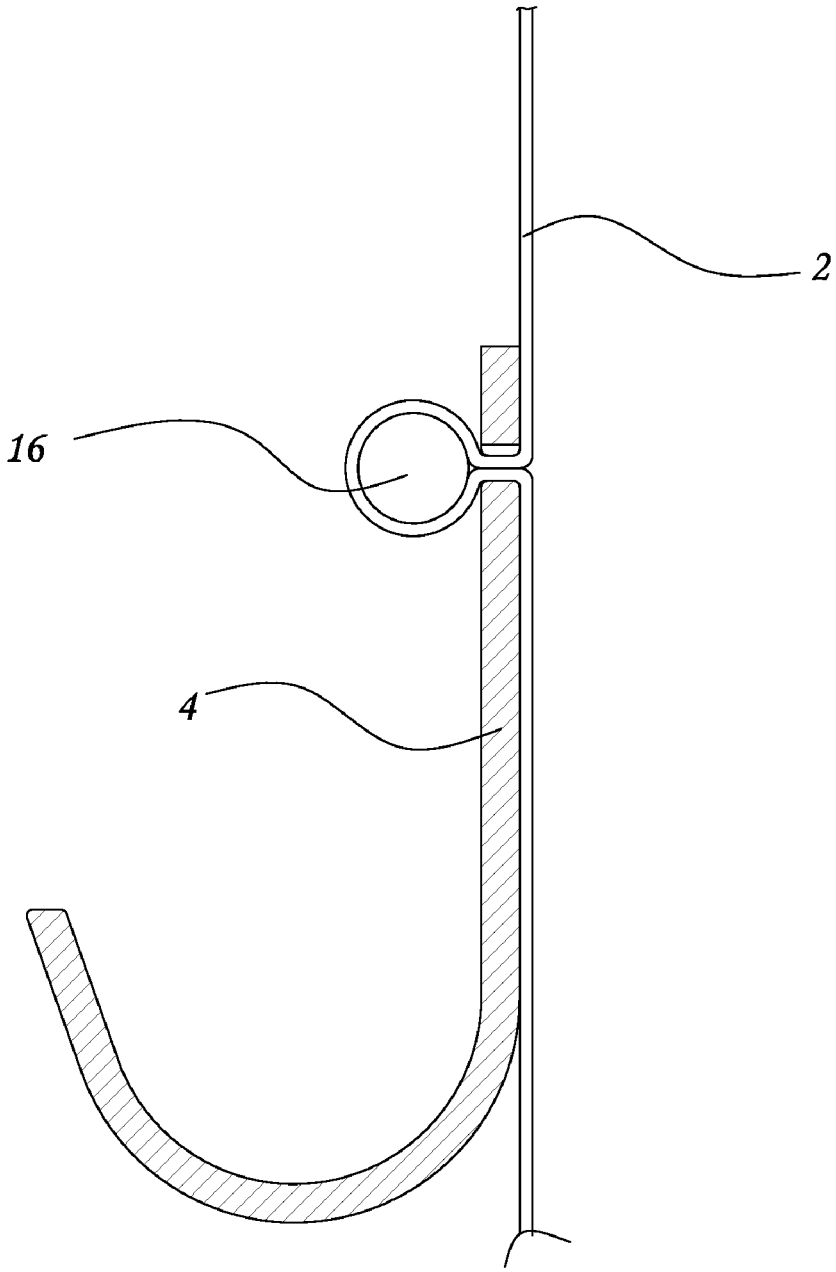
FIG. 13 is a sectional side view of a part of FIG. 12 showing the connection structure between the hanging strap and the hanger hook.

Referring to FIGS. 11~13, the hanging strap 2 can be made of a single elongated flexible sheet member having a plurality of transverse pockets 22 arranged at different elevations for receiving a positioning pin 16 respectively. Further, hanger hooks 4 may be fastened to the hanging strap 2 for hanging things. Each hanger hook 4 has a transverse slot 41 approximately equal to the size of the transverse slot 33 of the hanging hook 3. Thus, the procedure of fastening the hanger hooks 4 to the hanging strap 2 is same as the procedure of fastening the hanging hook 3 to the hanging strap 2.

A prototype of hanging rack assembly has been constructed with the features of FIGS. 1~13. The hanging rack assembly functions smoothly to provide all of the features disclosed earlier.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A hanging rack assembly, comprising:

a hanging strap, said hanging strap having a plurality of transverse pin holes arranged at different elevations;

a hanging hook adapted to hook said hanging strap on a support, said hanging hook having an angled hook portion located on one end thereof, an arched hook portion located on an opposite end thereof, and a transverse slot located on a middle part thereof for the passing of said hanging strap;

a plurality of hanging racks fastened to said hanging straps at different elevations for hanging things, each said hanging rack comprising two vertical flat bars arranged in parallel, two transverse bars respectively fastened to front and back sides of said vertical bars and kept in flush with the topmost edges of said vertical bars and defining with said vertical bars a vertically extending passage, and a plurality of hanger bars respectively obliquely fastened to said vertical bars for hanging things; and a plurality of positioning pins that are respectively fitted into said transverse pin holes of said hanging strap to secure said hanging hook and said hanging rack to said hanging strap after insertion of said hanging strap through the transverse slot of said hanging hook and the passage of each said hanging rack, said positioning pins having a diameter greater than the width of said transverse slot and the width of the passage of each said hanging rack between the two transverse bars of the respective hanging rack.

2. The hanging rack assembly as claimed in claim 1, wherein said hanger bars are respectively obliquely fastened to front and back sides of said vertical bars for hanging things.

3. The hanging rack assembly as claimed in claim 1, wherein said hanger bars are respectively obliquely fastened to one side of each of said vertical bars for hanging things.

4. The hanging rack assembly as claimed in claim 1, wherein said transverse bars are respectively fastened to said vertical bars with dowel pins; said hanger bars are respectively fastened to said vertical bars with dowel pins.

5. The hanging rack assembly as claimed in claim 1, wherein said hanging strap is formed of two narrow elongated flexible sheet members that are fastened together with stitches, having said transverse pin holes defined therein at different elevations.

6. The hanging rack assembly as claimed in claim 1, wherein said hanging strap is formed of a single elongated flexible sheet member having multiple parts thereof folded up and stitched to provide a plurality of transverse pockets at different elevations, each said transverse pocket defining therein one said transverse through hole.

7. The hanging rack assembly as claimed in claim 6, further comprising a plurality of hanger hooks selectively fastened to said hanging strap to substitute for said hanging racks for hanging things, each said hanger hook having a transverse slot for the passing of said hanging strap, the transverse slot of each said hanger hook being approximately equal to the transverse slot of said hanging hook in size.

* * * * *